US006867558B2

(12) United States Patent
Gaus, Jr. et al.

(10) Patent No.: US 6,867,558 B2
(45) Date of Patent: Mar. 15, 2005

(54) METHOD AND APPARATUS FOR NETWORKED LIGHTING SYSTEM CONTROL

(75) Inventors: Richard C. Gaus, Jr., Burnt Hills, NY (US); Kenneth Welles, Scotia, NY (US); Janos Sarkozi, Niskayuna, NY (US)

(73) Assignee: General Electric Company, Cleveland, OH (US)

( * ) Notice: Subject to any disclaimer, the term of this patent is extended or adjusted under 35 U.S.C. 154(b) by 51 days.

(21) Appl. No.: 10/435,984

(22) Filed: May 12, 2003

(65) Prior Publication Data

US 2004/0227472 A1 Nov. 18, 2004

(51) Int. Cl.[7] ..... H05B 37/00

(52) U.S. Cl. ..... 315/314; 315/313; 315/316; 315/320

(58) Field of Search ..... 315/314, 313, 315/316, 329, 324, 315, 291

(56) References Cited

U.S. PATENT DOCUMENTS 6,392,368 B1 5/2002 Deller et al. ..... 315/317
6,583,719 B2 * 6/2003 Okada et al. ..... 340/310.01

* cited by examiner

*Primary Examiner*—Tuyet T. Vo
(74) *Attorney, Agent, or Firm*—Fletcher Yoder

(57) ABSTRACT

A method and apparatus are described for a networked lighting system that may be controlled either remotely or locally by a power line communication (PLC) link. The components of the system, addressable lamp ballasts and addressable wall switches, replace their conventional counterparts. The resulting networked lighting system implemented with these components is controlled remotely from a centralized building control center. A particular room may be controlled by the building control center or locally by a wall switch. The invention requires no rewiring of the building's wiring plant, because the addressable components are direct electrical replacements, and installation of the system, therefore, takes a minimum amount of time.

29 Claims, 4 Drawing Sheets

METHOD AND APPARATUS FOR NETWORKED LIGHTING SYSTEM CONTROL

BACKGROUND OF THE INVENTION

Lighting systems are implemented to provide area lighting in households and buildings. For large buildings, such as commercial and industrial buildings having a large number of light sources, it is often beneficial to provide one or more central control systems for the lighting system such that any of the light sources may be controlled remotely. A central control system may provide a facilities manager, for instance, with the ability to remotely control each of the light sources and from a central location. By providing a central system, a facilities manager can save energy by remotely switching each of the light sources off at a particular time of day, for instance, thereby reducing the amount of light being wasted in locations that no longer require illumination.

To provide central control for an existing lighting system, addressable wall switches and/or addressable ballasts may be implemented. However, the implementation and installation involved with typical lighting system upgrades, disadvantageously include plant rewiring. That is to say that upgrades often require more than just component replacement and use of existing wiring. For instance, a limited lighting control system may be implemented using the digital addressable lighting interface (DALI) protocol, for example. Disadvantageously, the architecture associated with the DALI protocol may require the addition of control wiring. Further, the installation of a control system may be complicated, expensive, and disruptive to daily operation of a facility. More specifically, upgrading to a centralized lighting control system may include the tedious job of replacing components, tracing wiring, and rewiring to accommodate the new components.

BRIEF DESCRIPTION OF THE INVENTION

In accordance with one aspect of the present techniques, there is provided a networked lighting system comprising: a plurality of addressable wall switches; a plurality of addressable ballasts, wherein each of the plurality of addressable ballasts is coupled to a respective one of the plurality of addressable wall switches; and a plurality of lamps, wherein each of the plurality of lamps is coupled to a respective one of the plurality of addressable ballasts, and wherein each of the plurality of lamps comprises an on state and an off state; wherein each of the plurality of addressable wall switches and addressable ballasts is configured to replace non-addressable components in a manual lighting system, without rewiring the manual lighting system.

In accordance with another aspect of the present techniques, there is provided a networked lighting system comprising: an addressable wall switch comprising: a manual wall switch comprising an open state and a closed state and configured to interrupt current in a first power line segment when the manual wall switch comprises the open state; and a power line communication (PLC) module coupled to the manual wall switch via the first power line segment, wherein the PLC module is configured to transmit a control signal along a second power line segment in response to a change in the state of the manual wall switch or in response to a command from a remote central controller; and an addressable ballast coupled to the PLC module and configured to control the illumination of a lamp in response to the control signal.

In accordance with still another aspect of the present techniques, there is provided a networked lighting system comprising: a lamp comprising an on state and an off state; a centralized controller configured to send lighting commands to the lamp, wherein the lighting commands indicate a desired state of the lamp; an addressable wall switch coupled along a power line and comprising a first embedded controller configured to receive the lighting commands from the centralized controller and configured to transmit the lighting commands along the power line and comprising a manual switch located locally with respect to the lamp and configured to allow a local user to interrupt current along the power line, and wherein the manual switch comprises an open state and a closed state; and an addressable ballast comprising a second embedded controller and configured to change the state of the lamp in response to the lighting commands received from the fist embedded controller or in response to a current interruption from the manual switch.

In accordance with yet another aspect of the present techniques, there is provided a method of upgrading a networked lighting system comprising: cutting a first wire coupled between a line voltage and a first terminal of a wall switch; cutting a second wire coupled between a second terminal of the wall switch and a ballast; cutting a third wire coupled between the ballast and a neutral line; cutting a fourth wire coupled between the ballast and a lamp; coupling an addressable wall switch between the first wire and the second wire; coupling an addressable ballast between the second wire and the third wire; and coupling the addressable ballast between the second wire and the fourth wire.

In accordance with a further aspect of the present techniques, there is provided a method of remotely controlling a lamp, comprising: transmitting a control signal from a remote location to an addressable wall switch comprising a manual wall switch having and open state and a closed state and comprising a power line communication (PLC) module coupled to the manual wall switch, wherein the control signal is transmitted over a power line; transmitting the control signal from the addressable wall switch to an addressable ballast having a low current mode of operation and a normal mode of operation, wherein the addressable ballast comprises an embedded controller and a switchable load; and transmitting a voltage signal from the addressable ballast to a lamp having an on state and an off state.

BRIEF DESCRIPTION OF THE DRAWINGS

Advantages and features of the invention may become apparent upon reading the following detailed description and upon reference to the drawings in which.

DETAILED DESCRIPTION OF SPECIFIC EMBODIMENTS

Figure 1:
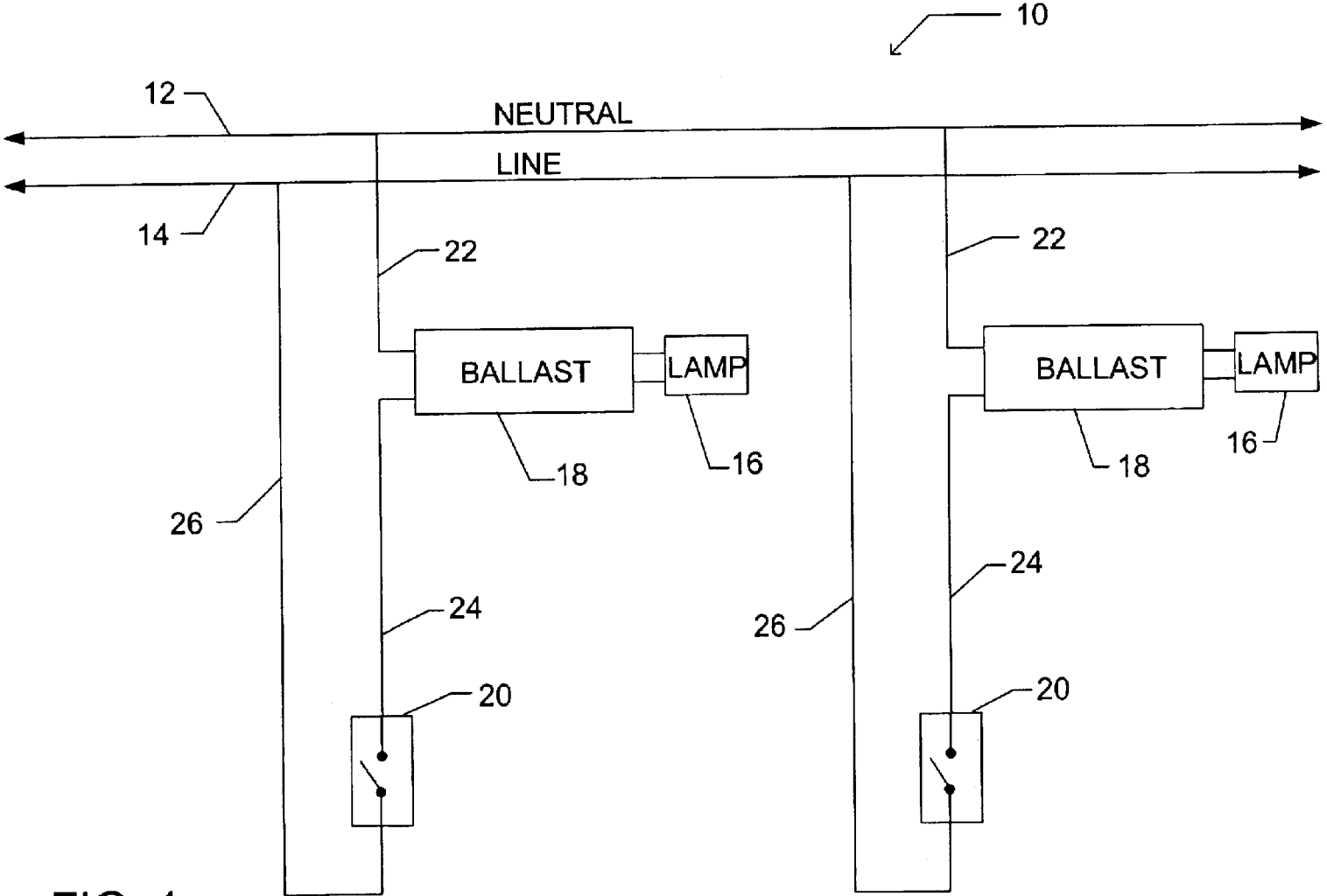
FIG. 1 is a block diagram illustrating a lighting system.

FIG. 1 illustrates a block diagram of a portion an exemplary lighting system 10 that may be implemented in a household or building, for example. As can be appreciated, the lighting system 10 generally includes a neutral line 12 and a voltage line 14. For typical households, the voltage line 14 may carry a line voltage of 110 volts, for example. For conventional commercial buildings, the voltage line may carry a line voltage of 277 volts, for example. The lighting system 10 includes lamps 16, which may comprise a general area lighting source, such as a fluorescent light, for example. The exemplary embodiment of the lighting system 10 of FIG. 1 illustrates two lamps 16, which may be implemented in a home or building. However, as can be appreciated, in commercial applications, the lighting system 10 may include hundreds or thousands of lamps 16, distributed throughout a building. Each lamp 16 generally includes a light producing or "on state," and an "off state," wherein no light is produced. As can be appreciated, the on state of the lamp 16 may also include various levels of illumination, thus making the lamp 16 "dimmable."

Discharge lamps, such as fluorescent lamps, may implement a ballast 18 to maintain a stable discharge current in the lamp 16, as can be appreciated by those skilled in the art. The ballast 18 provides a high starting voltage to ignite the lamp 16 followed by a current-limiting mode of operation. Electronic ballasts 18 may accomplish this task through the use of active semiconductor switches and reactive passive components such as inductors and capacitors. More specifically, the ballast 18 may include a pair of serially connected switches, such as MOSFETs, which convert direct current into alternating current for supplying a resonant load circuit in which the gas discharge lamp 16 is positioned, as can be appreciated.

Each respective lamp 16 may also include a switch, such as a manual wall switch 20. As can be appreciated, the wall switch is coupled between the voltage line 14 and the ballast 18. In the exemplary system 10, one input of the ballast 18 is coupled to the neutral line 12 via a wire path 22. The other input of the ballast 18 is coupled to one terminal of the manual wall switch 20 via a wire path 24. The second terminal of the switch 20 is coupled to the voltage line 14 via a wire path 26. When the manual wall switch 20 is closed (generally indicated on a manual wall switch 20, as "on,") the voltage is supplied to the lamp 16 through the ballast 18 and the lamp 16 is illuminated or in the on-state. When the manual wall switch 20 is open or (generally indicated on the manual wall switch 20, as "off,") the voltage from the voltage line 14 is interrupted and the lamp 16 is in the off-state and does not illuminate.

As can be appreciated, the system 10 provides a system wherein each lamp 16 is controlled manually by a respective wall switch 20. In other words, the state of the lamp 16 is controlled exclusively by the state of the manual wall switch 20. However, as previously described, it may be advantageous to modify the system 10 such that it may be controlled from one or more centralized locations. One method of providing centralized control of the lighting system 10 is to implement "addressable" wall switches and ballasts. As used herein, "addressable" means that a device is uniquely identifiable and can be individually controlled based on the unique identification, as can be appreciated by those skilled in the art. One exemplary technique for installing addressable ballasts and addressable wall switches is to sever the connection between the manual wall switch 20 and the ballast 18. In the present system 10, the wire path 24 may be broken. The ballast input that was coupled to the manual wall switch 20 may then be coupled directly to the voltage line 14. The wire path 24 from the manual wall switch 20 may be connected to the neutral line 12, and the manual wall switch 20 may be replaced by a power line communication (PLC) transceiver module, as can be appreciated by those skilled in the art. Disadvantageously, this technique of inserting a PLC transceiver module may require plant rewiring.

Thus, this exemplary method of providing centralized control for the lighting system 10 has several disadvantages related to the rewiring described above. Disadvantageously, a significant amount of time may be spent breaking and making wiring connections for each lamp 16 in the system 10. Further, correct identification of the respective wiring to ensure proper connection of the broken wires may be time consuming and may introduce a number of errors upon reconnection. Still further, the standard wire color-coding in the manual wall switch 20 disadvantageously becomes non-standard once these wiring changes have been made. That is to say, a wire that previously carried the line-voltage (from the voltage line 14) to the ballast 18 via the manual wall switch 20 and wire path 24 is now coupled to the neutral line 12 when connected to the PLC transceiver module. However, as can be appreciated, the color code of the wire path 24 is not standard for the neutral line 12 which may cause confusion if later modifications are made to the system 10. Additionally, if standard wire color coding is to be used for the addressable wall switches, then much time and effort would be used to rewire the lighting system.

Figure 2:
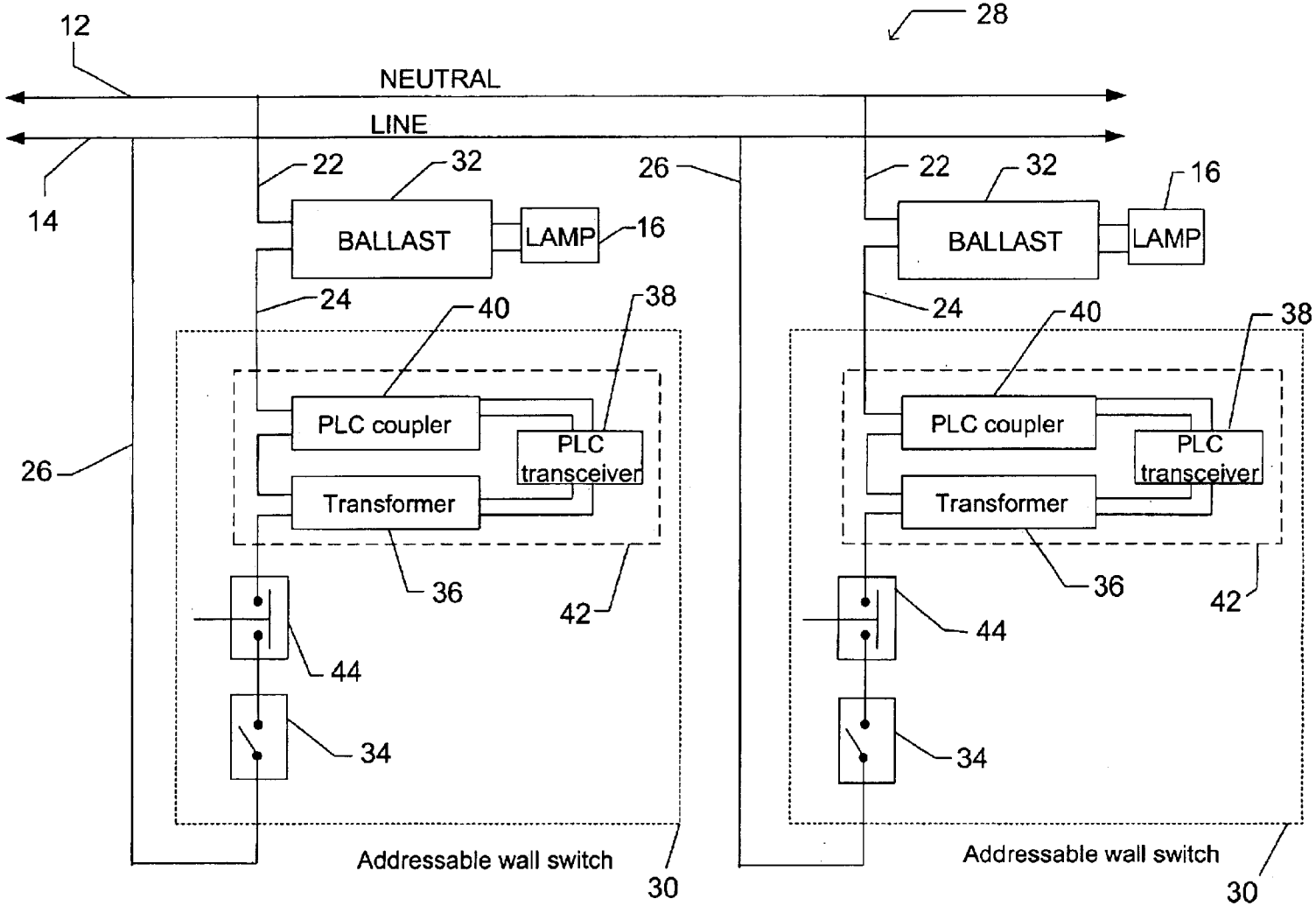
FIG. 2 is block diagram of an addressable lighting system in accordance with one exemplary embodiment of the present techniques.

FIG. 2 illustrates a block diagram of a networked lighting system 28 implementing addressable wall switches 30 and addressable ballasts 32 in accordance with the present techniques. As can be appreciated, the system 28 is similar to the system 10. For convenience, like reference numerals are used to designate previously described elements. To implement centralized control of the lighting system, each ballast 18 (of FIG. 1) is replaced with a respective addressable ballast 32, and each manual wall switch 20 (of FIG. 1) is replaced with a respective addressable wall switch 30. For simplicity, in the present exemplary embodiment, each addressable wall switch 30 is coupled to a respective addressable ballast 32 via the wire path 24 and coupled to the voltage line 14 via the wire path 26. However, as can be appreciated, each of the manual wall switches 20 of the lighting system 10 (FIG. 1) may control a number of ballasts 18. Similarly, each respective addressable wall switch 30 may control a number of addressable ballasts 32. Accordingly, each addressable wall switch 30 may be coupled to a plurality of addressable ballasts 32.

Referring again to the exemplary embodiment illustrated in FIG. 2, each addressable ballast 32 is further coupled to the neutral line 12 via the wire path 22. As can be appreciated, an upgrade from a manual lighting system to a centralized control system having the architecture of the present system 28 requires no plant rewiring. That is to say that the wire paths 22, 24 and 26 are not rewired. Each ballast 18 and each switch 20 are simply replaced with an addressable ballast 32 and an addressable wall switch 30, thereby allowing usage of the prior plant wiring, by simply connecting the addressable ballast 32 and the addressable wall switch 30 to the cut wire paths 22, 24 and 26. Thus, the system 28 is a low-cost means to convert a conventional lighting system that is not remotely controllable to a fully controlled and energy efficient lighting system. As can be appreciated, the addressable wall switch 30 may also be implemented with a non-addressable ballast 18 instead of the addressable ballast 32, wherein the addressable wall switch 30 simply functions as a typical wall switch capable of only manual control. The addressable ballast 32 will be described in more detail with respect to FIG. 4. Likewise, an addressable ballast 32 may be used in connection with a manual wall switch, where the remote control of the addressable ballast 32 is valid only when the manual wall switch is turned on.

The addressable wall switch 30 includes a manual wall switch 34 to allow for, manual control of the lamp 16, as previously described with reference to FIG. 1. As previously described, the addressable wall switch 30 is configured to provide power to the addressable ballast 32 (or a plurality of addressable ballasts 32), as long as the manual wall switch 34 is in the closed state or "on." However, to provide the ability to remotely control the lamp 16 when the lamp is off due to a PLC command, the addressable ballast 32 includes a low-power mode in order that it may receive a remote command while the lamp 16 is off. For example, in one embodiment, the lamp 16 may comprise a 25 watt lamp. For a 25 watt lamp 16, the addressable ballast 32 may draw about 100 mA (0.1 amp) of current. In a low-power mode, the addressable ballast may implement about 1 watt of power (about 4 mA of current). Accordingly, the addressable wall switch 30 is configured to provide power to the addressable ballast 32, even when the lamp 16 is in the off-state, as described further below. Conventional wall switches may be configured to receive a maximum of 15 amps. If one addressable wall switch 30 is implemented to control multiple addressable ballasts 32, as discussed above, one addressable wall switch 30 may be advantageously configured to implement a multiple of 100 mA loads up to the rated maximum current (e.g., 15 amps) of the addressable wall switch 30. As used herein, "adapted to," "configured to," and the like refer to elements that are arranged or manufactured to form a specified structure, to perform a specified function, or to achieve a specified result.

To provide the ability to control the illumination of each lamp 16 remotely from one or more central locations, for example, a power line communication (PLC) command may be delivered from the central location through the voltage line 14 to the addressable ballast 32. As further explained further below, the addressable ballast 32 is configured to receive commands from the central control area. The central building control may be implemented to send control commands directly to the addressable ballast 32. The addressable wall switch 30 may passively monitor the remote commands that are sent to the addressable ballast 32, as can be appreciated by those skilled in the art.

Further, for local control, the addressable ballast 32 is configured to receive commands directly from the addressable wall switch 30. The addressable wall switch 30 is configured to provide a voltage signal to the addressable ballast and to provide the PLC command to the addressable ballast 32, during local control. The addressable ballast 32 advantageously receives the voltage signal and power line communication (PLC) commands from the addressable wall switch 30 and controls the lamp 16 according to the PLC command, as described further below.

To facilitate local control of the addressable ballast 32, a PLC module 42 is provided in the addressable wall switch 30. The PLC module 42 comprises a transformer 36, a PLC transceiver 38, and a PLC coupler 40 to facilitate the local control of the addressable ballast 32. Generally speaking, the transformer 36 is configured to provide power to the PLC transceiver 38. The PLC transceiver 38 provides a communication link between the addressable ballast 32 and the remote control center. Specifically, the PLC transceiver 38 includes an embedded controller, which is configured to deliver command signals to the addressable ballast 32 in response to local commands. The PLC transceiver 38 is configured to initiate commands to the addressable ballast 32, in response to changes in local conditions, such as a change in the state of the manual wall switch 34 or a push button switch 44 which may be manually implemented by a user to briefly interrupt the current flow to the addressable ballast 32. If the manual wall switch 34 is in the "on" position and the lamp 16 has been turned off remotely, the push button switch 44 may be implemented to reset the current to the addressable ballast 32, thereby turning the lamp 16 on, as described further below. The PLC coupler 40 provides the means to connect outgoing signals from, and incoming signals to the PLC transceiver 38 by acting as a high impedance to the power line 14 frequency and a low impedance to the PLC frequency implemented by the PLC transceiver 38, as can be appreciated by those skilled in the art.

The implementation and functionality of the system 28 may be better understood with reference to Table 1, below. Table 1 illustrates the possible states of the lamp 16 of the system 28, as determined by the combined states of the addressable ballast 32 and the manual wall switch 34. As can be appreciated, if the manual wall switch 34 is "off," the lamp 16 of the system 28 cannot be controlled remotely. That is to say that the manual wall switch 34 has priority over the remote control of each respective lamp 16.

TABLE 1

| State number | Manual wall switch 34 position state | Addressable ballast 32 programmed state | Ballast 32 electrical state | Actual lamp 16 State |
|---|---|---|---|---|
| 1 | Off | Off-to-on | Not energized | Off |
| 2 | On | Off | Energized (low current mode) | Off |
| 3 | On | On | Energized | On |

In state 1, the manual wall switch 34 is "off," and the addressable ballast 32 is not energized or off. The addressable ballast 32 may be pre-programmed such that in the transition state from off-to-on, the addressable ballast 32 will turn the lamp 16 on when the addressable ballast 32 is energized. The addressable ballast 32 will be ready to accept commands from a remote control room via the PLC module 42. In this condition, the manual wall switch 34 (i.e., the manual operator in the room containing the manual wall switch 34) has priority over building control to turn the lamp 16 off.

In state 2, the manual wall switch 34 is in the "on" position, but the addressable ballast 32 has been turned off by a command from the building control center delivered via the PLC module 42. That is to say that the addressable ballast 32 is in the low-current mode of operation, wherein the lamp 16 is off, but the addressable ballast 32 receives enough current from the PLC module 42 to receive PLC commands. In this mode, the addressable ballast 32 is in a low-current state, and the PLC tranceiver module 38 in the addressable wall switch 30 is unable to issue any commands to change the state of the addressable ballast 32, because there is not enough power in the PLC module 42 to energize the addressable ballast 32 (discussed further with reference to FIG. 4). The room occupant may turn the lamp 16 "on" via the addressable ballast 32 by momentarily interrupting the current flow by pushing the push button switch 44. When the addressable ballast 32 senses the interruption in the current by the action of the push button switch, the addressable ballast 32 transitions to the on state and draws more current from the transformer 36 (state 3). The increased current through the transformer 36 is sufficient to provide power to the PLC transceiver 38, thereby enabling commands to be sent from the PLC transceiver 38 to the addressable ballast 32, such that the lamp 16 may be turned on, dimmed, or turned off, as described with reference to state 3, below.

In state 3, the manual wall switch 34 is in the "on" position. The addressable ballast 32 is also on. In this state, sufficient current is flowing such that power is supplied to the PLC transceiver 38 in the addressable wall switch 30, permitting local control of the addressable ballast 32 for on, off, and dimming commands. As can be appreciated, in state 3, the addressable ballast 32 may be controlled remotely by a building control center or locally.

The system 28 advantageously provides a lighting system that may be controlled remotely, wherein the addressable wall switch 30 and the addressable ballast 32 may be installed without rewiring the current lighting system. As described above, the system 28 provides for remote lighting control from one or more central control areas. However, as described above, in the exemplary embodiment of the system 28, the manual wall switch 34 has priority over the remote control of the lamp 16. That is to say that if the manual wall switch 34 is turned off, the lamp 16 cannot be illuminated remotely. In some instances, it may be advantageous to provide a system wherein the lamp 16 can be controlled remotely, regardless of the state of the manual wall switch 34.

Figure 3:
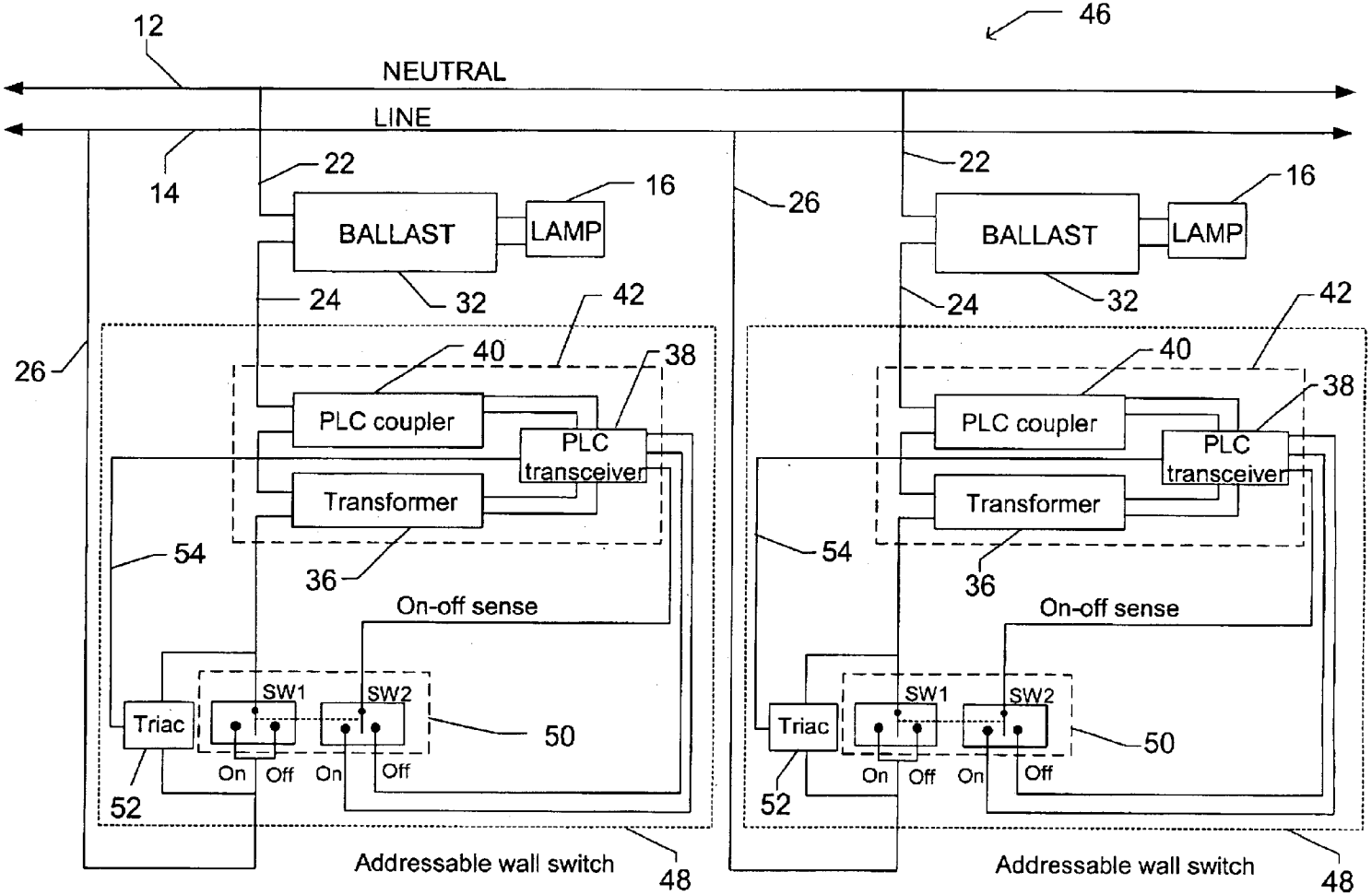
FIG. 3 is block diagram of an addressable lighting system in accordance with another exemplary embodiment of the present techniques.

Referring now to FIG. 3, a block diagram of an exemplary networked lighting system 46, wherein the priority of the manual wall switch over remote building control is removed. Accordingly, the addressable system 46 provides a system that can be remotely controlled regardless of the state (i.e. "on" or "off") of the manual wall switch. As with the system 28, the system 46 includes a number of lamps 16 and respective addressable ballasts 32. Each addressable ballast 32 is coupled to the neutral line 12 via the wire path 22. The system 46 also includes an addressable wall switch 48, described further below. In the present exemplary embodiment, each addressable wall switch 48 is coupled to a respective addressable ballast 32 via the wire path 24 and coupled to the voltage line 14 via the wire path 26. Alternatively, as described above, each addressable wall switch 48 may control a plurality of addressable ballasts 32. As with the upgrade from the system 10 to the system 28, the architecture of the present system 46 may be implemented by replacing the standard ballast 18 and switch 20 (of FIG. 1) with an addressable ballast 32 and an addressable wall switch 48, thereby allowing usage of the prior plant wiring. The addressable ballast 32 will be described in more detail with respect to FIG. 4.

The addressable wall switch 48 includes a manual wall switch 50 to allow for manual control of the lamp 16, as previously described with reference to FIG. 1. The addressable wall switch 48 is configured to provide power to the addressable ballast 32 through the manual wall switch 50 when the manual wall switch 50 is in the closed "on" state. The addressable wall switch 48 is configured to provide power to the addressable ballast 32, even if the manual wall switch 50 is "off." Accordingly, the manual wall switch 50 comprises a ganged switch SW1/SW2 and a triac 52. As can be appreciated, the triac 52 is a three terminal semiconductor device for controlling current in two directions, determined by the signal provided by the control path 54. The triac 52 is coupled across the switch SW1 such that even when the manual wall switch 50 (and thus, each of the switches SW1 and SW2) is in the "off" state, the lamp 16 may be controlled remotely, as further described below.

To facilitate the implementation of local PLC commands, a PLC module 42 is provided in the addressable wall switch 30. As previously described, the PLC module 42 enables the local control of each lamp 16. The PLC module 42 comprises a transformer 36, a PLC transceiver 38, and a PLC coupler 40 to facilitate the remote and local control of the addressable ballast 32. As previously described, the transformer 36 is configured to provide power to the PLC transceiver 38. The PLC transceiver 38 provides a communication link between the addressable wall switch 48 and either the addressable ballast 32 or the remote control center. As previously described, the PLC transceiver 38 includes an embedded controller, which is configured to receive PLC commands in response to local input. The PLC transceiver 38 is further configured to initiate commands to the addressable ballast 32, in response to changes in local conditions, such as the interruption in the current flow to the addressable ballast 32 initiated by a local user implementing the manual control switch 50. The PLC tranceiver module 38 is coupled to the triac 52 via the control path 54. The triac 52 may be controlled by the embedded controller in the PLC tranceiver 38 such that current to the addressable ballast 32 may be controlled when the switch 50 is "off," but current still flows because the control to the triac 52 is activated. The PLC coupler 40 provides the means to connect outgoing signals from, and incoming signals to the PLC transceiver 38 by acting as a high impedance to the power line 14 frequency and a low impedance to the PLC frequency implemented by the PLC transceiver 38, as can be appreciated by those skilled in the art.

The implementation and functionality of the system 46 may be better understood with reference to Table 2, below. Table 2 below illustrates the possible states of the lamp 16 of the system 46, as determined by the combined states of the addressable ballast 32 and the manual wall switch 50.

TABLE 2

| State number | Ganged SW1/SW2 position state | Addressable ballast 32 programmed state | Addressable Ballast 32 electrical state | Actual lamp 16 state |
|---|---|---|---|---|
| 1 | Off | Off-to-on | Energized (low current mode) | Off |
| 2 | Off | On | Energized | On |
| 3 | On | Off-to-on | Energized (low current mode) | Off |
| 4 | On | On | Energized | On |

In state 1, the addressable ballast 32 is energized in the low-current mode, and the lamp 16 is "off." The addressable ballast 32 may be controlled remotely from one or more central locations. Locally, the room occupant may turn the lamp 16 "on" by momentarily interrupting current flow by changing the state of the manual wall switch 50 (ganged switch SW1/SW2). The addressable ballast 32 detects the current interruption and transitions to an "on" state. In the "on" state, the addressable ballast 32 is energized and the local PLC transceiver module 38 has power to set the triac 52 to maintain current flow during any subsequent switch transitions while in the "on" state. As previously described, the triac 52 is controlled by the embedded processor in the PLC transceiver module 38. As can be appreciated, even while the manual wall switch 50 is in the "off" state, the ballast 32 may be controlled remotely via the PLC module 42 and the triac 52.

In state 2, the ganged manual wall switch 50 is in the "off" position, but the addressable ballast 32 is energized as a result of being turned on by remote building control. An occupant in the room containing the manual wall switch 50 may control the lamp 16 by issuing commands to the addressable ballast by the powered local PLC transceiver module 38 of the addressable wall switch 48. Advantageously, the triac 52 maintains current flow during transitions of the manual wall switch 50. Current to the ballast 32 is not interrupted because SW1 of the ganged manual wall switch 50 is bypassed by the triac 52 under control of the local embedded processor in the PLC transceiver module 38. However, the processor interprets switch commands by sensing the position information of SW2 of the ganged manual wall switch 50. Accordingly, the addressable ballast 32 may be controlled remotely via the PLC module 42, and the addressable ballast 32 may be controlled locally by the embedded processor in the PLC transceiver module 38.

In state 3, the ganged manual wall switch 50 is in the "on" position, the addressable ballast 32 is in the low-current mode, and the lamp 16 is off. The addressable ballast 32 may be controlled remotely by building, control, and the addressable ballast 32 may be turned on by a momentary interruption of current supplying the addressable ballast 32 by changing the state of ganged manual wall switch 50. In state 3, the PLC transceiver module 38 is not powered. The lamp 16 may be turned on locally by a room occupant by a momentary current interruption when the manual wall switch 50 is manually transitioned from off to on.

In state 4, the ganged manual wall switch 50 is "on" and the addressable ballast 32 is on. The PLC transceiver module 38 is powered and the triac 52 maintains current during any transitions of the manual wall switch 50. The embedded processor in the PLC transceiver module 38 interprets switch transitions and issues commands to the addressable ballast 32.

Figure 4:
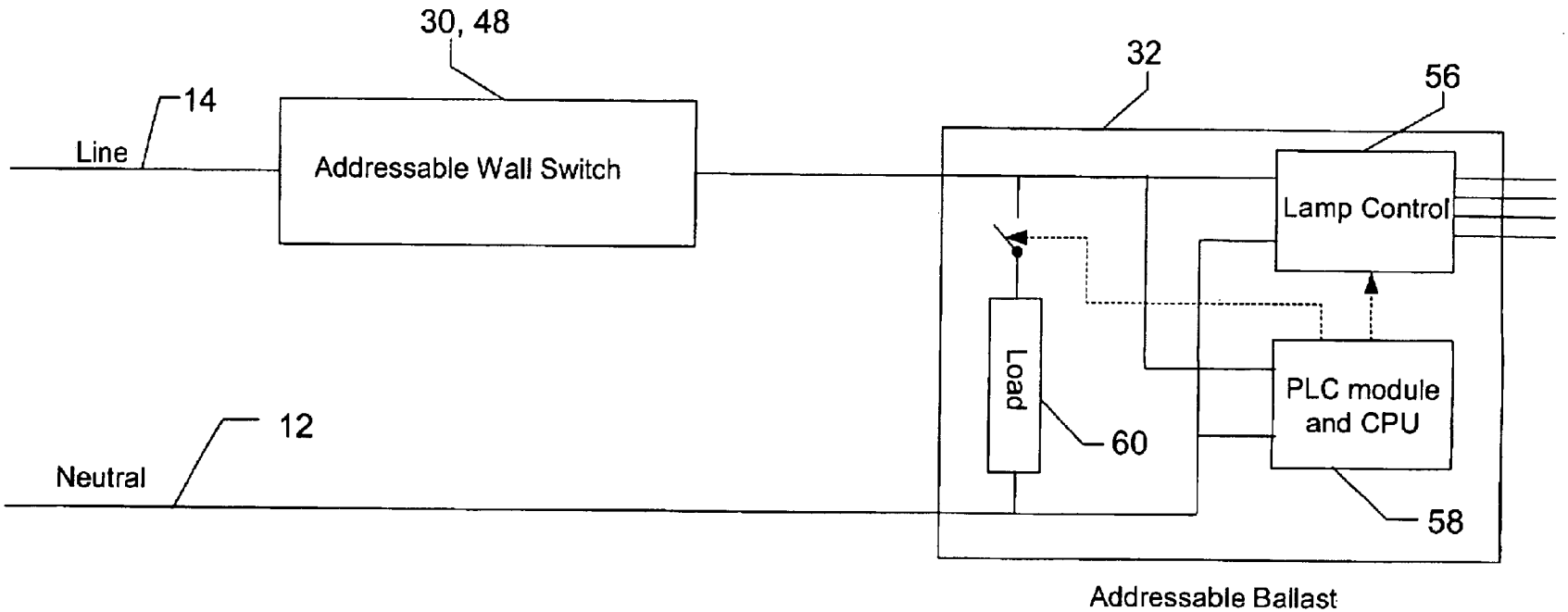
FIG. 4 is a block diagram of an addressable ballast system in accordance with a further exemplary embodiment of the present techniques.

FIG. 4 illustrates a block diagram of an addressable ballast 32. As can be appreciated, the addressable ballast 32 includes a lamp control block 56 which is coupled to the lamp 16 (illustrated in FIGS. 1–3). As can be appreciated, the lamp control block 56 is configured to maintain a stable discharge current in the lamp 16. The lamp control block 56 may advantageously provide a high starting voltage to ignite the lamp 16 followed by a current-limiting mode of operation. The lamp control block 56 may include active semiconductor switches and reactive passive components such as inductors and capacitors, for instance. More specifically, the lamp control block 56 may include a pair of serially connected switches, such as MOSFETs, which convert direct current into alternating current for supplying a resonant load circuit in which the lamp 16 is positioned.

Further, the lamp control block 56 may advantageously facilitate varying the illumination of the lamp 16 when the lamp 16 is in the on-state. That is to say, that the lamp control block 56 may advantageously provide for dimming of the lamp 16 in response to a dimming command received from the central control center or a local manual dimming control (not illustrated). It should be noted that the local manual dimming control may be included in the addressable wall switch 30, 48 and can be implemented as either a rotary-type control or a touch-activated duration-type control, or the like, such that the amount of dimming corresponds to the position or duration of the command, as described further below. Such commands may be interpreted by the embedded controller in the PLC transceiver 38 of the addressable wall switch 30, 48 and issued to the addressable ballast 32 via the PLC module 42, as can be appreciated.

Further, the addressable ballast 32 advantageously includes a PLC module 58. As with the PLC module 42, the PLC module 58 includes a transformer, a PLC transceiver having an embedded processor and a PLC coupler. As with the components of the PLC module 42, the embedded processor in the PLC transceiver in the addressable ballast 32 interprets commands received remotely from the centralized control center or locally detected conditions and controls the state of the lamp 16 accordingly.

When the addressable ballast 32 is fully on and the lamp 16 is illuminated, the PLC transceiver module 38 in the addressable wall switch 30, 48 is powered and can send commands to the addressable ballast 32. In this embodiment, the addressable wall switch 30, 48 includes a dimming control (not shown) to allow a room occupant to select the dimming level manually, by adjusting the dimming control. The embedded processor in the PLC transceiver module 38 relays the dimming command directly to the addressable ballast 32 via the PLC module 42. In one exemplary embodiment, the dimmable control may include a push button switch that is controlled in response to the duration of a user's touch. In this embodiment, the addressable ballast 32 begins dimming at a predetermined rate given by the duration of the occupant's command. As the room occupant depresses the dimming switch, the addressable ballast 32 draws less current, and the embedded PLC transceiver 38 in the addressable wall switch 30, 48 becomes inactive.

The addressable ballast 32 may include a switchable load 60 to facilitate the dimming of the lamps 16 when the addressable ballast 32 is in a low current mode of operation. When the addressable ballast 32 is in the low current mode, because it has received a command to dim the lamps 16, the PLC transceiver module 38 in the addressable wall switch 30, 48 is inactive due to a lack of available power from the line voltage 14. The room occupant may press the dimming switch, either for increasing or decreasing the illumination level of the lamp 16. Pressing the dimming switch interrupts low current flow to the addressable ballast 32 and signals the addressable ballast 32 that the addressable wall switch 30, 48 is ready to issue a command. In this instance, the addressable ballast 32 switches in the switchable load 60 causing enough current to flow through the addressable wall switch 30, 48 to power the PLC module 42 in the addressable wall switch 30, 48. The embedded processor in the PLC transceiver module 38 is activated, reads the dimming command from the dimmer switch and delivers a command to the addressable ballast 32, indicating the amount of dimming desired. The lamp's intensity increases or decreases in accordance with the occupant's command. Following the response to this command, the addressable ballast 32 switches out the switchable load 60 and awaits another command.

As can be appreciated, the present techniques provide a networked lighting system which implements addressable wall switches 30, 48 and/or addressable ballasts 32. The present system may be implemented to replace/upgrade a lighting system such that it may be remotely controlled from one or more central locations. Advantageously, the presently described upgrades may be implemented without complex rewiring of system components. Further, installation of addressable components can be done quickly and incrementally at the convenience of a customer.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A networked lighting system comprising:

a plurality of addressable wall switches;

a plurality of addressable ballasts, wherein each of the plurality of addressable ballasts is coupled to a respective one of the plurality of addressable wall switches; and a plurality of lamps, wherein each of the plurality of lamps is coupled to a respective one of the plurality of addressable ballasts, and wherein each of the plurality of lamps comprises an on state and an off state;

wherein each of the plurality of addressable wall switches and addressable ballasts is configured to replace non-addressable components in a manual lighting system, without rewiring the manual lighting system.

2. The networked lighting system, as set forth in claim 1, wherein the on state comprises one or more illumination levels.

3. The networked lighting system, as set forth in claim 2, wherein the addressable ballast is configured to receive the control signal when the manual wall switch is in the open state.

4. The networked lighting system, as set forth in claim 1, wherein each of the plurality of addressable wall switches comprises:

a manual wall switch comprising an open state and a closed state, and configured to receive a voltage signal from a voltage source, and further configured to transmit the voltage signal along a first signal path when the manual wall switch is in the closed state; and a power line communication (PLC) module configured to receive the voltage signal along the first signal path when the manual wall switch is in the closed state and further configured to transmit a command signal to a respective one of the plurality of addressable ballasts.

5. The networked lighting system, as set forth in claim 4, wherein the power line communication (PLC) module comprises:

a transformer configured to receive the voltage signal from the voltage source, when the manual wall switch is in the closed state;

a PLC transceiver coupled to the transformer and comprising an embedded controller; and a PLC coupler coupled between the PLC transceiver and the respective one of the plurality of addressable ballasts and further coupled between the transformer and the respective one of the plurality of addressable ballasts.

6. The networked lighting system, as set forth in claim 4, wherein the addressable ballast comprises a second power line communication (PLC) module configured to switch the lamp to the on state or the off state in response to the command signal received from the first PLC module.

7. The networked lighting system, as set forth in claim 6, wherein the addressable ballast comprises a switchable load coupled to the second PLC module.

8. The networked lighting system, as set forth in claim 4, wherein the addressable wall switch comprises a push-button switch configured to temporarily interrupt the voltage signal along the first signal path in response to a manual depression of the push-button switch.

9. The networked lighting system, as set forth in claim 8, wherein the PLC transceiver is configured to transmit the command signal to the addressable ballast in response to one of a change in the state of the manual wall switch, a manual depression of the push-button switch and the command signal being sent to the addressable wall switch from a remote location.

10. The networked lighting system, as set forth in claim 4, wherein the manual wall switch comprises a ganged wall switch having a first switch (SW1) functionally correlated with a second switch (SW2).

11. The networked lighting system, as set forth in claim 10, comprising a triac having a first power terminal, a second power terminal and a gate terminal, wherein the gate terminal is coupled to the PLC transceiver and each of the first and second power terminals is coupled to a respective terminal of the first switch (SW1).

12. The networked lighting system, as set forth in claim 11, wherein the triac is configured to transmit the command signal to the PLC module when the first switch (SW1) is in the open state.

13. A networked lighting system comprising:

an addressable wall switch comprising:

a manual wall switch comprising an open state and a closed state and configured to interrupt current in a first power line segment when the manual wall switch is in the open state; and a power line communication (PLC) module coupled to the manual wall switch via the first power line segment, wherein the PLC module is configured to transmit a control signal along a second power line segment in response to a change in the state of the manual wall switch or in response to a command from a remote central controller; and an addressable ballast coupled to the PLC module and configured to control the illumination of a lamp in response to the control signal.

14. The networked lighting system, as set forth in claim 13, wherein PLC module comprises:

a PLC transceiver configured to transmit the control signal to the addressable ballast;

a transformer configured to provide power to the PLC transceiver; and a PLC coupler configured to receive the power signal from the transformer and further configured to receive the control signal from the PLC transceiver and to deliver each of the power signal and the control signal to the addressable ballast.

15. The networked lighting system, as set forth in claim 14, wherein the addressable ballast comprises a low current mode of operation and a normal mode of operation, wherein the lamp is in an off state when the addressable ballast is in the low current mode of operation.

16. The networked lighting system, as set forth in claim 15, wherein the addressable ballast comprises a switchable load configured to enable current to the transformer in the PLC module, wherein the current is sufficient to power the PLC transceiver when the addressable ballast is in the low current mode of operation.

17. The networked lighting system, as set forth in claim 14, wherein the manual wall switch comprises a push button switch configured to temporarily interrupt the current from the second power line segment to the addressable ballast.

18. The networked lighting system, as set forth in claim 17, wherein the addressable ballast is configured to provide enough current to the PLC transformer in the addressable wall switch to power the PLC transceiver to transmit the control signal to the addressable ballast when the addressable ballast is in the low current mode of operation.

19. A networked lighting system comprising:

a lamp comprising an on state and an off state;

a centralized controller configured to send lighting commands to the lamp, wherein the lighting commands indicate a desired state of the lamp;

an addressable wall switch coupled along a power line and comprising a first embedded controller configured to receive the lighting commands from the centralized controller and configured to transmit the lighting commands along the power line and comprising a manual switch located locally with respect to the lamp and configured to allow a local user to interrupt current along the power line, and wherein the manual switch comprises an open state and a closed state; and an addressable ballast comprising a second embedded controller and configured to change the state of the lamp in response to the lighting commands received from the fist embedded controller or in response to a current interruption from the manual switch.

20. The networked lighting system, as set forth in claim 19, wherein the manual switch comprises a push button switch configured to temporarily interrupt the current along the power line, by temporarily changing the manual switch to the open state.

21. The networked lighting system, as set forth in claim 19, wherein the addressable ballast is configured to receive the lighting commands when the manual switch comprises the open state or the closed state.

22. The networked lighting system, as set forth in claim 19, comprising a triac having a first power terminal, a second power terminal and a gate terminal, wherein the gate terminal is coupled to the first embedded controller and each of the first and second power terminals is coupled in parallel with the manual switch, and wherein the triac is configured to transmit the lighting commands from the centralized controller to the first embedded controller when the manual switch is in an open state.

23. The networked lighting system, as set forth in claim 19, wherein the addressable ballast comprises a switchable load configured to enable power to the first embedded controller.

24. A method of upgrading a networked lighting system comprising:

cutting a first wire coupled between a line voltage and a first terminal of a wall switch;

cutting a second wire coupled between a second terminal of the wall switch and a ballast;

cutting a third wire coupled between the ballast and a neutral line;

cutting a fourth wire coupled between the ballast and a lamp;

coupling an addressable wall switch between the first wire and the second wire;

coupling an addressable ballast between the second wire and the third wire; and coupling the addressable ballast between the second wire and the fourth wire.

25. The method of upgrading a networked lighting system, as set forth in claim 24, wherein coupling an addressable wall switch between the first wire and the second wire comprises:

coupling a manual wall switch to the first wire; and coupling a power line communication (PLC) module between the manual wall switch and the second wire, wherein the PLC module comprises a first embedded controller configured to receive control signals.

26. The method of upgrading a networked lighting system, as set forth in claim 25, wherein coupling an addressable ballast between the second wire and the third wire comprises coupling an addressable ballast between the second wire and the third wire, wherein the addressable ballast comprises a second embedded controller configured to receive the control signals from the first embedded controller and further configured to control the lamp.

27. A method of remotely controlling a lamp, comprising:

transmitting a control signal from a remote location to an addressable wall switch comprising a manual wall switch having and open state and a closed state and comprising a power line communication (PLC) module coupled to the manual wall switch, wherein the control signal is transmitted over a power line;

transmitting the control signal from the addressable wall switch to an addressable ballast having a low current mode of operation and a normal mode of operation, wherein the addressable ballast comprises an embedded controller and a switchable load; and transmitting a voltage signal from the addressable ballast to a lamp having an on state and an off state.

28. The method, as set forth in claim 27, comprising transmitting the control signal from the remote location to the lamp when the manual wall switch is in the open state.

29. The method, as set forth in claim 27, comprising transmitting the control signal from the remote location to the lamp, wherein the manual wall switch is in the closed state and wherein the control signal sets the lamp to the off state.

* * * * *